US010441081B2

(12) United States Patent
Carrera

(10) Patent No.: US 10,441,081 B2
(45) Date of Patent: Oct. 15, 2019

(54) SEATING AND LOUNGING FURNITURE

(71) Applicant: CIAR S.P.A., Pesaro (IT)

(72) Inventor: Massimo Carrera, Tavullia (IT)

(73) Assignee: CIAR S.P.A., Pesaro (IT)

( * ) Notice: Subject to any disclaimer, the term of this patent is extended or adjusted under 35 U.S.C. 154(b) by 0 days.

(21) Appl. No.: 16/000,217

(22) Filed: Jun. 5, 2018

(65) Prior Publication Data

US 2018/0352960 A1 Dec. 13, 2018

(30) Foreign Application Priority Data

Jun. 7, 2017 (DE) ..... 20 2017 103 410 U

(51) Int. Cl.

| | |
|---|---|
| ***A47C 1/03*** | (2006.01) |
| ***A47C 1/0355*** | (2013.01) |
| ***A47C 1/035*** | (2006.01) |
| ***A47C 1/024*** | (2006.01) |
| ***A47C 7/50*** | (2006.01) |

(52) U.S. Cl.
CPC ..... *A47C 1/0355* (2013.01); *A47C 1/024* (2013.01); *A47C 1/035* (2013.01); *A47C 7/506* (2013.01)

(58) Field of Classification Search
CPC ..... A47C 1/0355; A47C 1/024; A47C 1/035; A47C 7/506

(Continued)

(56) References Cited

U.S. PATENT DOCUMENTS 3,300,244 A * 1/1967 Hughes ..... A47C 1/0355 297/259.2
5,129,701 A * 7/1992 Pine ..... A47C 1/0355 297/68

(Continued)

FOREIGN PATENT DOCUMENTS

DE 202007006440 8/2007
DE 202016104352 9/2016

(Continued)

*Primary Examiner* — Syed A Islam
(74) *Attorney, Agent, or Firm* — Renner Kenner Greive Bobak Taylor & Weber

(57) ABSTRACT

The seating and lounging furniture according to the invention provides a frame, a backrest, a seat element, and a footrest, wherein the seat element is connected to the frame by means of a seat element adjustment mechanism for a displacement and tilting movement of the seat element relative to the frame, the footrest is connected to a front end of the seat element by means of a footrest adjustment mechanism for extending and retracting the footrest, the backrest is connected to a rear end of the seat element and to the frame via a backrest adjustment mechanism, only one linear actuator is provided for adjusting the seat element, the footrest, and the backrest between an upright base position and a reclining position of the seating and lounging furniture, wherein a first end of the actuator is coupled to the frame, and a second end is coupled to the seat element, the linear actuator when actuated generates a linear lift, made up of a first partial lift and a second partial lift, the first partial lift bringing about the displacement and pivoting movement of the seat element relative to the frame without an extension or retraction of the footrest, and the second partial lift bringing about a synchronous inclination of the backrest relative to the seat element and an extension or retraction of the footrest relative to the seat element.

15 Claims, 10 Drawing Sheets

(58) Field of Classification Search
USPC ..... 297/68, 83, 84, 85 R, 86, 88, 89
See application file for complete search history.

(56) References Cited

U.S. PATENT DOCUMENTS

| | | | | |
|---|---|---|---|---|
| 5,147,108 | A * | 9/1992 | LaPointe | A47C 1/03294 297/318 |
| 5,775,775 | A * | 7/1998 | Hoffman | A47C 1/0355 297/316 |
| 5,971,475 | A * | 10/1999 | Lawson | A47C 1/0355 297/68 |
| 6,135,559 | A * | 10/2000 | Kowalski | A47C 1/024 297/301.5 |
| 6,840,575 | B2 * | 1/2005 | Hesse | A47C 1/0355 297/75 |
| 9,332,844 | B2 * | 5/2016 | Regev | A47C 1/0242 |
| 9,635,943 | B2 * | 5/2017 | Lawson | A47C 1/03294 |
| 10,178,912 | B2 * | 1/2019 | Carrera | A47C 7/506 |
| 2014/0132039 | A1 * | 5/2014 | Lu | A61G 15/02 297/68 |
| 2015/0054316 | A1 * | 2/2015 | Donovan | A47C 1/0342 297/76 |
| 2016/0302573 | A1 | 10/2016 | Garland et al. | |
| 2017/0071344 | A1 * | 3/2017 | Marcantoni | A47C 1/029 |

FOREIGN PATENT DOCUMENTS

| | | |
|---|---|---|
| EP | 3143902 | 3/2017 |
| WO | WO2008129567 | 10/2008 |
| WO | WO2016014681 | 1/2016 |

* cited by examiner

SEATING AND LOUNGING FURNITURE

TECHNICAL FIELD

The invention relates to seating and lounging furniture having a frame, a backrest, a seat element, and a footrest.

BACKGROUND

Seating and lounging furniture is characterized in that it may be brought from an upright base position into a reclining position. Designs of this type are known in the market, in which the adjustment from the upright base position into the reclining position takes place solely by a shift in weight. In many designs, a footrest may also be extended.

In DE 20 2007 006 440 U1 it is proposed that the displacement of the seat part and the simultaneous inclination of the back part takes place by a shift in weight of a user of the reclining chair. In addition, a footrest may be independently retracted and extended by means of an electric motor. It is thus possible for the footrest to be extended and retracted, regardless of the position of the backrest.

Furthermore, a reclining chair is known from EP 3 143 902 A1 which likewise allows an independent adjustment of the footrest and the backrest. This is carried out in that a footrest adjustment mechanism is actuatable via a first actuator for extending and retracting the footrest, while a second mechanical linkage for adjusting the seat and the backrest cooperates with a second actuator.

SUMMARY

The object of the invention is to develop seating and lounging furniture that implements a motor-driven individual adjustment of the backrest and the footrest in a more cost-effective manner.

This object is achieved according to the invention by the features of claim 1.

The seating and lounging furniture according to the invention provides a frame, a backrest, a seat element, and a footrest, wherein

- the seat element is connected to the frame by means of a seat element adjustment mechanism for a displacement and tilting movement of the seat element relative to the frame,
- the footrest is connected to a front end of the seat element by means of a footrest adjustment mechanism for extending and retracting the footrest,
- the backrest is connected to a rear end of the seat element and to the frame via a backrest adjustment mechanism,
- only one linear actuator is provided for adjusting the seat element, the footrest, and the backrest between an upright base position and a reclining position of the seating and lounging furniture, wherein
- a first end of the actuator is coupled to the frame, and a second end is coupled to the seat element,
- the linear actuator when actuated generates a linear lift, made up of a first partial lift and a second partial lift, the first partial lift bringing about the displacement and pivoting movement of the seat element relative to the frame without an extension or retraction of the footrest, and the second partial lift bringing about a synchronous inclination of the backrest relative to the seat element and an extension or retraction of the footrest relative to the seat element.

The seating and lounging furniture according to the invention allows a displacement and pivoting movement of the seat element relative to the frame without the footrest being extended in the process. However, with the same linear actuator, the extension and retraction of the footrest is then also possible with a further partial lift.

Thus, compared to EP 3 143 902 A1, for a very similar adjustment of the seating and lounging furniture, one actuator may be dispensed with, thereby reducing the costs of the product.

Further embodiments of the invention are the subject matter of the subclaims.

According to a first embodiment of the invention, the seat element and the backrest in the base position enclose a first angle, and at the end of the first partial lift enclose a second angle, the first angle and the second angle differing from one another by less than 10°, preferably by less than 5°, and very preferably by less than 3°. It is also provided that this angle between the seat element and the backrest during the second partial lift increases by an angle of at least 10°, preferably by at least 15°, and very preferably by at least 20°. This has the effect that the actual reclining position does not result until during the second partial lift, in which the footrest is also extended. In contrast, only a slightly tilted-back position of the seat element and the backrest result after the first partial lift.

According to another embodiment of the invention, a linkage mechanism is provided which connects the backrest, the seat element, and the footrest to one another. This linkage mechanism may in particular include a first linkage part, a second linkage part, and a third linkage part that are coupled together. The first linkage part may hereby couple the footrest adjustment mechanism to the second linkage part, while the second linkage part is coupled to the seat element, and the third linkage part connects the second linkage part to the backrest adjustment mechanism. This linkage mechanism thus represents a connection between the three movable parts (seat element, backrest, and footrest), and forms one conceivable exemplary embodiment for moving all three parts via a single actuator, however, with the footrest not being actuated until during the second partial lift.

In addition, a stop element may be provided for assisting in this motion sequence. This stop element comes into contact with the seat element adjustment mechanism at the end of the first partial lift of the linear actuator.

Furthermore, at least one first spring element may be provided between the frame and the seat element, or between the frame and the seat element adjustment mechanism, for assisting in the displacement and pivoting movement of the seat element.

According to another embodiment of the invention, the force to be applied for actuating the seat element adjustment mechanism, starting from the upright base position into the first intermediate position at the end of the first partial lift, is less than the force to be applied for actuating the footrest adjustment mechanism. This ensures that the footrest is not extended until the second partial lift of the linear actuator.

In one particular exemplary embodiment of the invention, the linear actuator is coupled to the seat element via a crossmember. In particular, the second end of the linear actuator may be articulatedly coupled to the crossmember about a first articulation axis, while the footrest adjustment mechanism is coupled to the seat element about a parallel second articulation axis, whereby the distance, perpendicular to the lift direction of the linear actuator, between the first and the second articulation axis in the upright base position is smaller than at the end of the first partial lift of the linear actuator. The smaller the distance at the beginning of the first partial lift, the smaller the effective lever arm and the greater the force that is necessary for extending the footrest. The distance between the two axes is therefore dimensioned small enough that the footrest does not move at all or hardly moves during the first partial lift of the linear actuator. In the tests underlying the invention, it has been found to be advantageous when the distance, perpendicular to the lift direction of the linear actuator, between the first and the second articulation axis is selected to be less than 3 mm in the upright base position of the sitting and reclining furniture.

In another embodiment of the invention, it is provided that the seat element adjustment mechanism moves the seat element from the upright base position into a first intermediate position at the end of the first partial lift, wherein in the upright base position a first clear distance is formed between the front end of the seat element and a floor, and in the first intermediate position a second clear distance is formed between the front end of the seat element and the floor, the first clear distance being less than the second clear distance. Due to this lifting of the front end of the seat element, the clear distance from the floor, necessary for extending and retracting the footrest, may be selected to be greater than the first clear distance that is present in the upright base position, provided that the greater second clear distance in the intermediate position is sufficient to extend the footrest. The frame of the seating and lounging furniture may thus have a lower design, and the space that is gained may be utilized, for example, for thicker padding of the seat element. However, extending the footrest is still possible, since the necessary space is initially provided by lifting the front area of the seat element. However, this in turn requires that the footrest is not moved or is hardly moved during the first partial lift, in which the necessary distance is not yet great enough. Therefore, the footrest is not extended until during the second partial lift, when the necessary clear distance is present.

BRIEF DESCRIPTION OF THE DRAWINGS

Further embodiments of the invention are explained in greater detail below with reference to the description of several exemplary embodiments, and the drawings, which show the following.

DETAILED DESCRIPTION

Figure 1A:
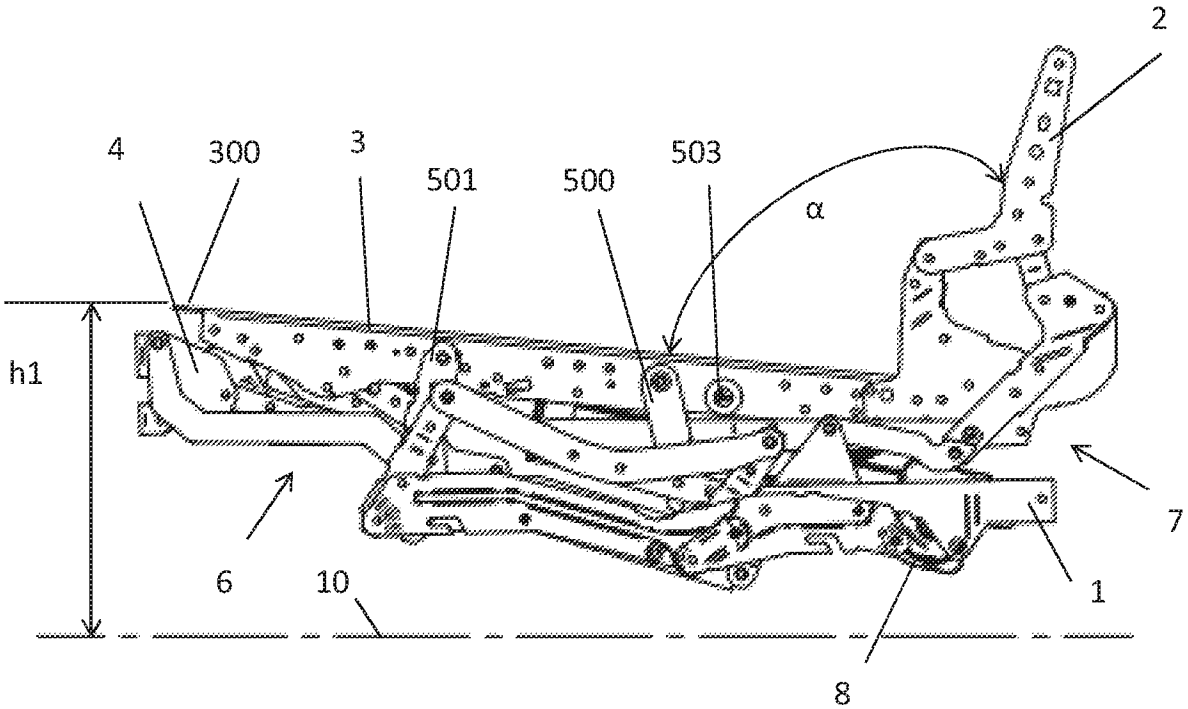
FIG. 1A shows a side view of the seating and lounging furniture in the upright base position.

The illustrations in the drawings show essentially only the mechanism of the seating and lounging furniture. All parts not of interest here, such as the padding in particular, have been omitted to allow a better illustration of the essential elements. FIG. 1A shows the upright base position of the seating and lounging furniture. It comprises essentially a frame 1, a backrest 2, a seat element 3, and a footrest 4. Some of the other parts of the mechanism may possibly not be visible in FIG. 1A; therefore, in this regard reference is made to the two other FIGS. 1B and 1C, which respectively show a first intermediate position, and the reclining position with the footrest 4 extended.

The seat element 3 is connected to the frame 1 by means of a seat element adjustment mechanism 5 for a displacement and tilting movement of the seat element 3 relative to the frame 1. The footrest 4 is connected to a front end 300 of the seat element 3 by means of a footrest adjustment mechanism 6 for extending and retracting the footrest 4. In contrast, the backrest 2 is coupled to a rear end of the seat element 3 and to the frame 1 via a backrest adjustment mechanism 7. For moving the seating and lounging furniture from the upright base position according to FIG. 1A, via the first intermediate position according to FIG. 1B, into the reclining position according to FIG. 1C, only one linear actuator 8, which moves the seat element 3 as well as the footrest 4 and the backrest 2, is provided. As is apparent in particular from FIGS. 3A through 3C, a first end 800 of the actuator 8 is coupled to the frame 1, and a second end 801 is coupled via a crossmember 803 to the seat element 3. For moving the sitting and reclining furniture from the upright base position according to FIG. 1A (FIG. 3A) into the first intermediate position according to FIG. 1B (FIG. 3B), the linear actuator carries out a first partial lift, whereby a displacement and pivoting movement of the seat element 3 relative to the frame 1 takes place without the footrest being extended. The seat element 3 is hereby lifted essentially at its front end 300, so that a first clear distance h1 between the front end 300 of the seat 3 and a floor 10, from the upright base position according to FIG. 1A to the first intermediate position according to FIG. 1B, changes into a greater second clear distance h2. At the same time, the front end 300 of the seat element 3 is moved slightly forward relative to the frame 1.

Figure 1B:
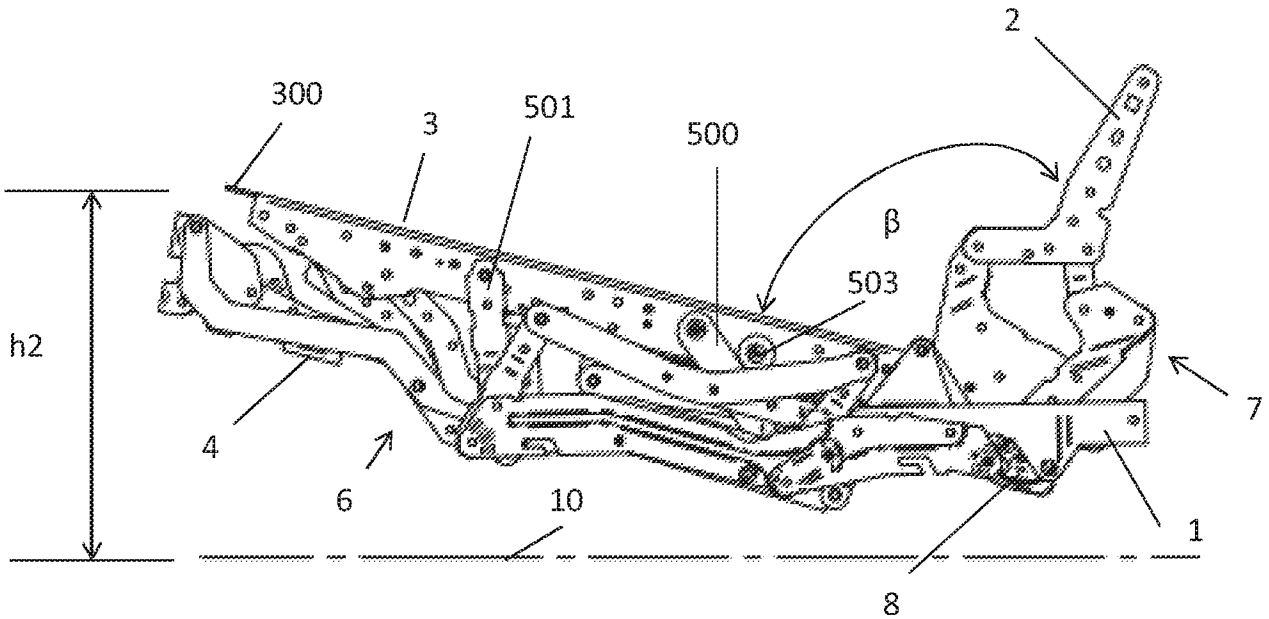
FIG. 1B shows a side view of the seating and lounging furniture in the intermediate position.
Figure 1C:
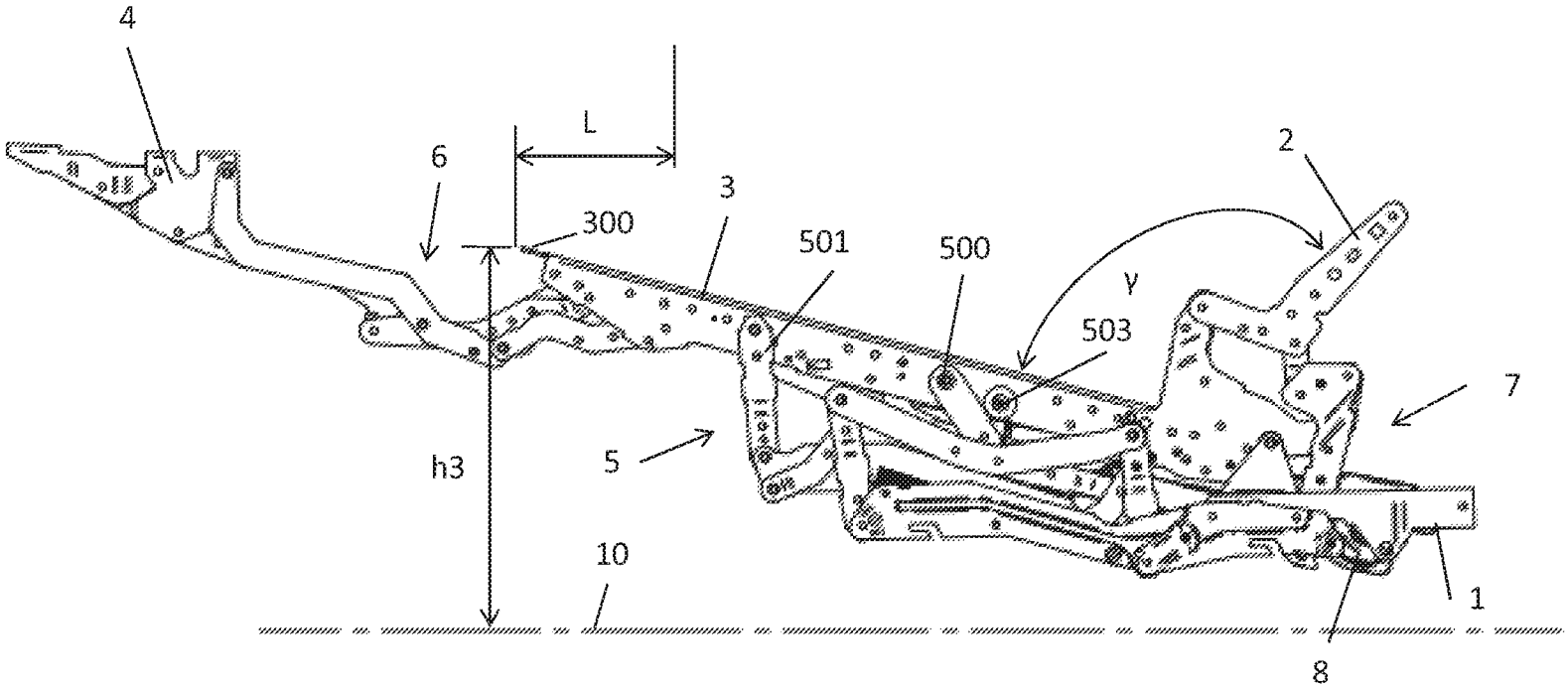
FIG. 1C shows a side view of the seating and lounging furniture in the reclining position with the footrest extended.

If the linear actuator 8 is further actuated in the same direction, a second partial lift follows which brings about a change in position from the first intermediate position according to FIG. 1B into the reclining position according to FIG. 1C. This results in a synchronous inclination of the backrest 2 relative to the seat element 3. In addition, the footrest 4 is extended relative to the seat element 3. It is to be noted here that the footrest 4 requires a clear height of at least h2 relative to the floor 10. The lower clear height h1 according to FIG. 1A would not be sufficient for this purpose. Therefore, the mechanism is also designed so that the footrest 4 is not extended until during the second partial lift, in which the necessary clear height is present. During the second partial lift, the front end 300 is moved further forward by the length L, while at the same time, the angle between the backrest 2 and the seat element 3 further increases. This results in the reclining position according to FIG. 1C.

The angle β between the seat element 3 and the backrest 2 in the first intermediate position according to FIG. 1B essentially corresponds to the angle α in the upright base position according to FIG. 1A, or is slightly larger. The angle is approximately 100°+/−5°, for example. In the reclining position according to FIG. 1C, an angle γ which is approximately 20°+/−5° larger than angle β results between the seat element 3 and the backrest 2.

In one exemplary embodiment of the invention, the clear height h1 in the upright base position is 270 mm+/−10 mm, for example. In the intermediate position according to FIG. 1B, the clear height h1 increases to approximately 305 mm+/−10 mm, and in the reclining position according to FIG. 1C may assume a height h3 of 347 mm+/−10 mm, for example.

Further embodiments of the mechanism are described in greater detail below with reference to FIGS. 2A through 3C. The linear actuator 8 at its first end 8 [sic; 800] is articulatedly coupled to a transversely extending base support 100 of the frame 1. At its second end 801 the linear actuator 8 is articulatedly coupled to a crossmember 803 via a short lever arm 804 that is nonrotatably connected to the crossmember 803. The coupling of the actuator is advantageously provided approximately in the middle of the crossmember 803. The crossmember extends to both sides of the seat element 3, and is pivotably connected thereto via one first articulation point 301 each. For this purpose, connecting plates 806 are nonrotatably fastened to the crossmember 803 at the two ends of the crossmember 803. The coupling to the first articulation point 301 is provided at one end of the connecting plate 806, while the footrest adjustment mechanism 6, made up of multiple parts, is articulatedly coupled at the other end. The footrest adjustment mechanism 6 is designed in the manner of a scissor mechanism, which with a first scissor arm 600 at a first articulation point 603 is articulatedly connected to the connecting plate 806 of the crossmember 803. A second scissor arm 601 of the footrest adjustment mechanism 6 is coupled to a first articulation point 900 of a linkage mechanism 9. This linkage mechanism 9 is made up of a first linkage part 901, a second linkage part 902, and a third linkage part 903, which are articulatedly coupled to one another. The first linkage part 901 at the first articulation point 900 is connected to the second scissor arm 601. At the other end, the first linkage part 901 is articulatedly connected to the second linkage part 902, in a middle area thereof. The second linkage part 902 at a second articulation point 904 is also coupled to the seat frame 3, and at the other end, at a third articulation point 905 is connected to the third linkage part 903, which at a fourth articulation point 906 in turn is coupled to the backrest adjustment mechanism 7.

The seat element 3 has a fastening plate 302 which is fixedly connected thereto and which has a second articulation point 303 for coupling the backrest 2, and a third articulation point 304 for articulating the backrest adjustment mechanism 7.

The backrest adjustment mechanism 7 has a connecting element 700 which is articulatedly coupled to the third articulation point 304, and which on the one hand is connected to the backrest 2 via a first articulated arm 701, and on the one hand is connected to the third linkage part 903 of the linkage mechanism in the area of the fourth articulation point 906.

The seat element adjustment mechanism 5 has a plurality of lever arms and connecting plates. For the displacement and tilting movement of the seat element 3, the seat element adjustment mechanism 5 in particular has a first lever arm 500 and a second lever arm 501 that are articulatedly connected to the seat element 3. In addition, a stop element 503 (FIGS. 1A through 1C) is provided on the seat element 3, and at the end of the first partial lift comes into contact with the first lever arm 500 and blocks further pivoting movement thereof (FIG. 1B). The contact of the lever arm with the stop element 503 thus represents reaching the first intermediate position according to FIG. 1B at the end of the first partial lift. During this first partial lift, the angle α formed by the backrest 2 and the seat element 3 in the upright base position according to FIG. 1A undergoes little or no change. The angle β between the backrest 2 and the seat element 3 is therefore identical to or only slightly larger than the angle α in the intermediate position according to FIG. 1B.

Figure 2A:
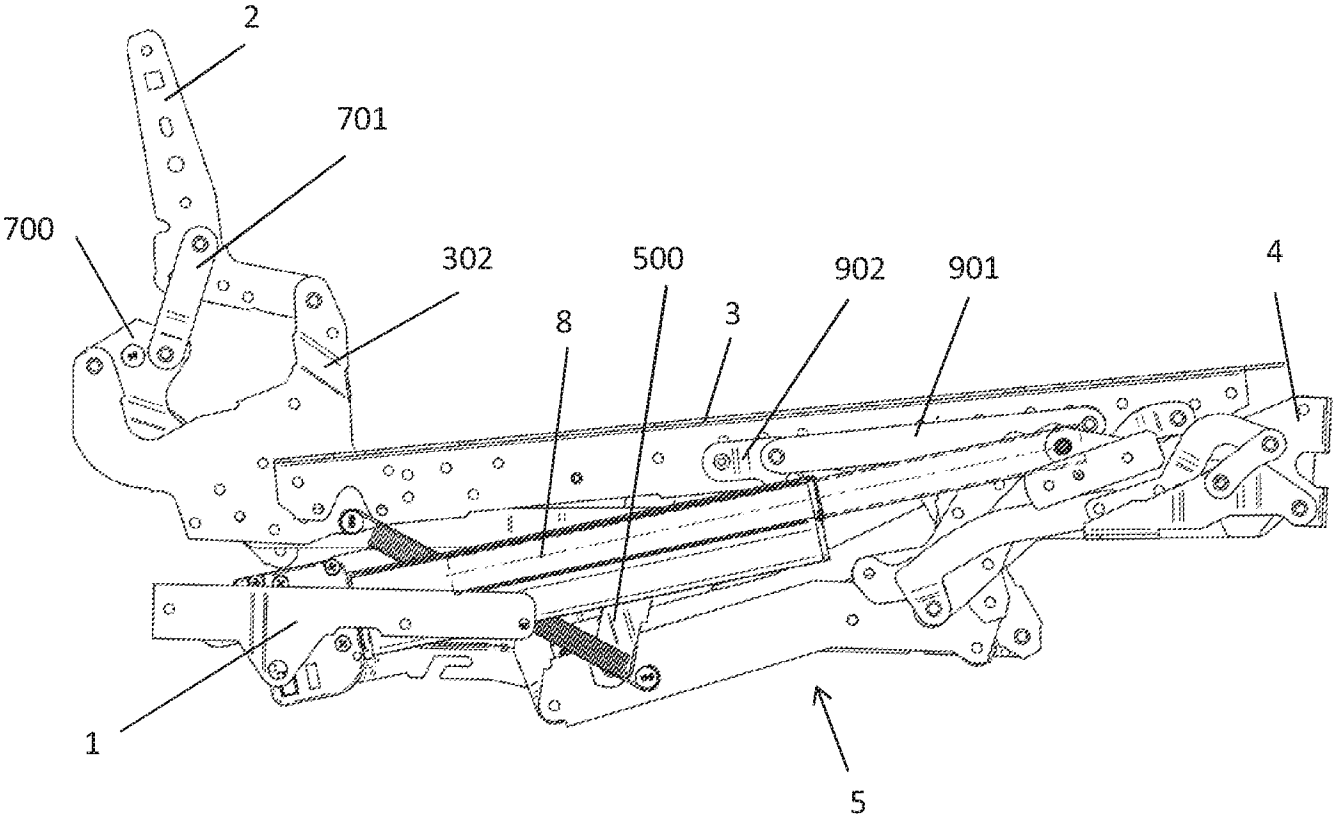
FIG. 2A shows an enlarged second side view of the seating and lounging furniture in the upright base position according to FIG. 1A.
Figure 2B:
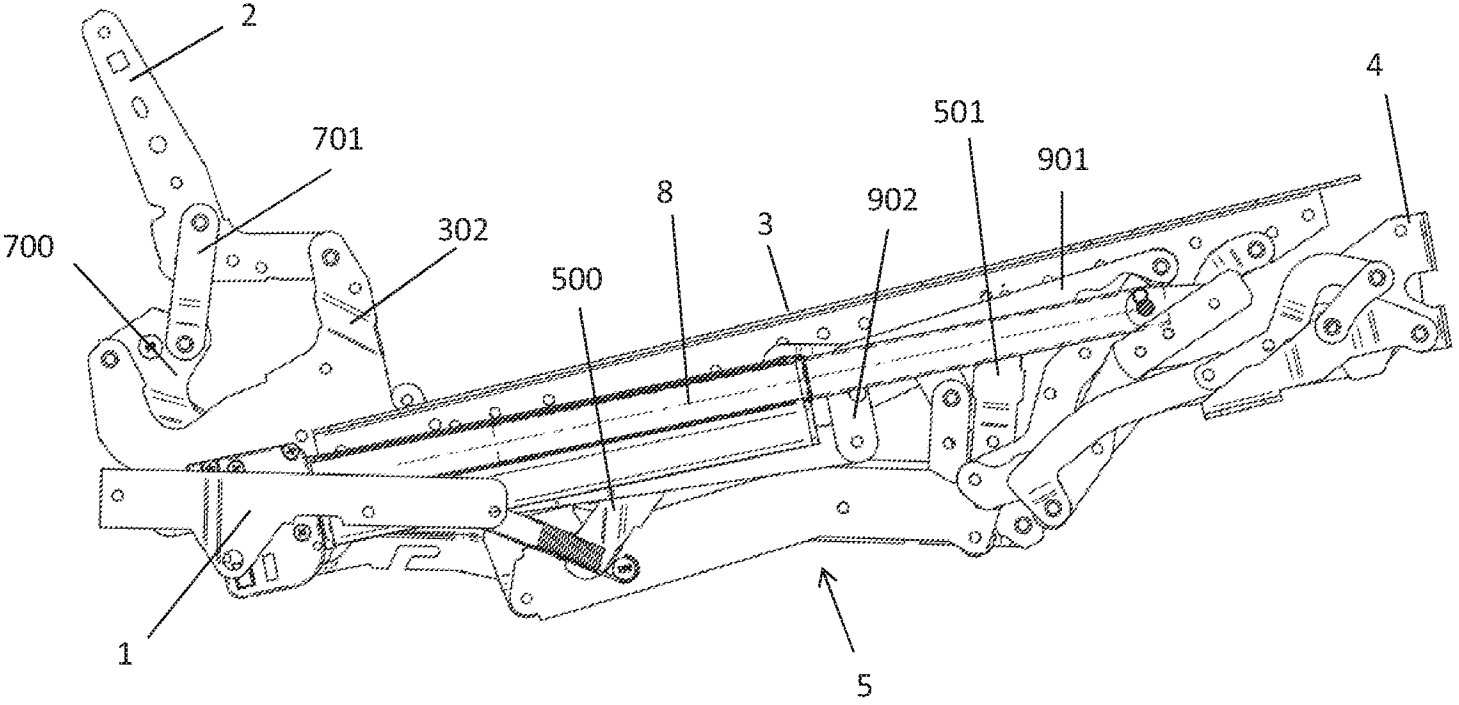
FIG. 2B shows an enlarged second side view of the seating and lounging furniture in the intermediate position according to FIG. 1B.
Figure 2C:
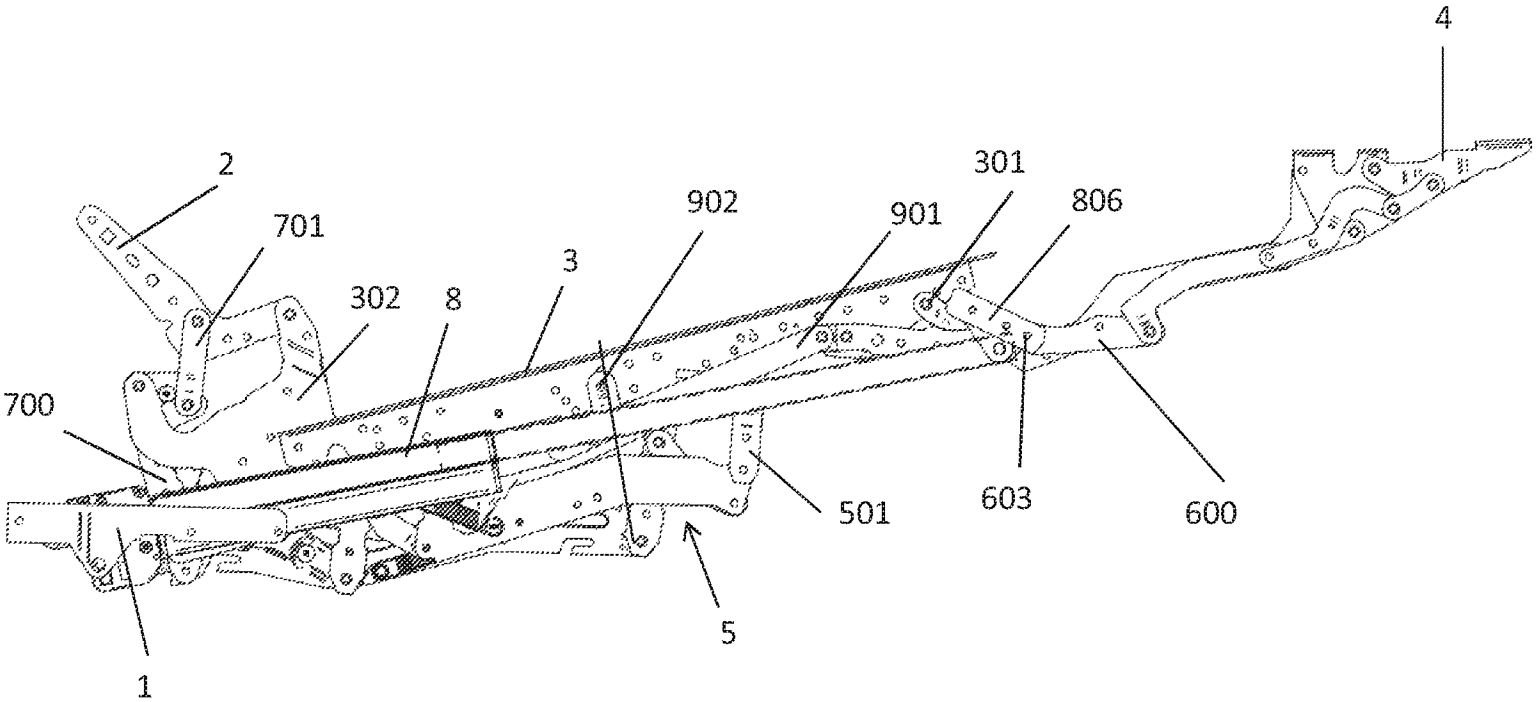
FIG. 2C shows an enlarged second side view of the seating and lounging furniture in the reclining position according to FIG. 1C.
Figure 3A:
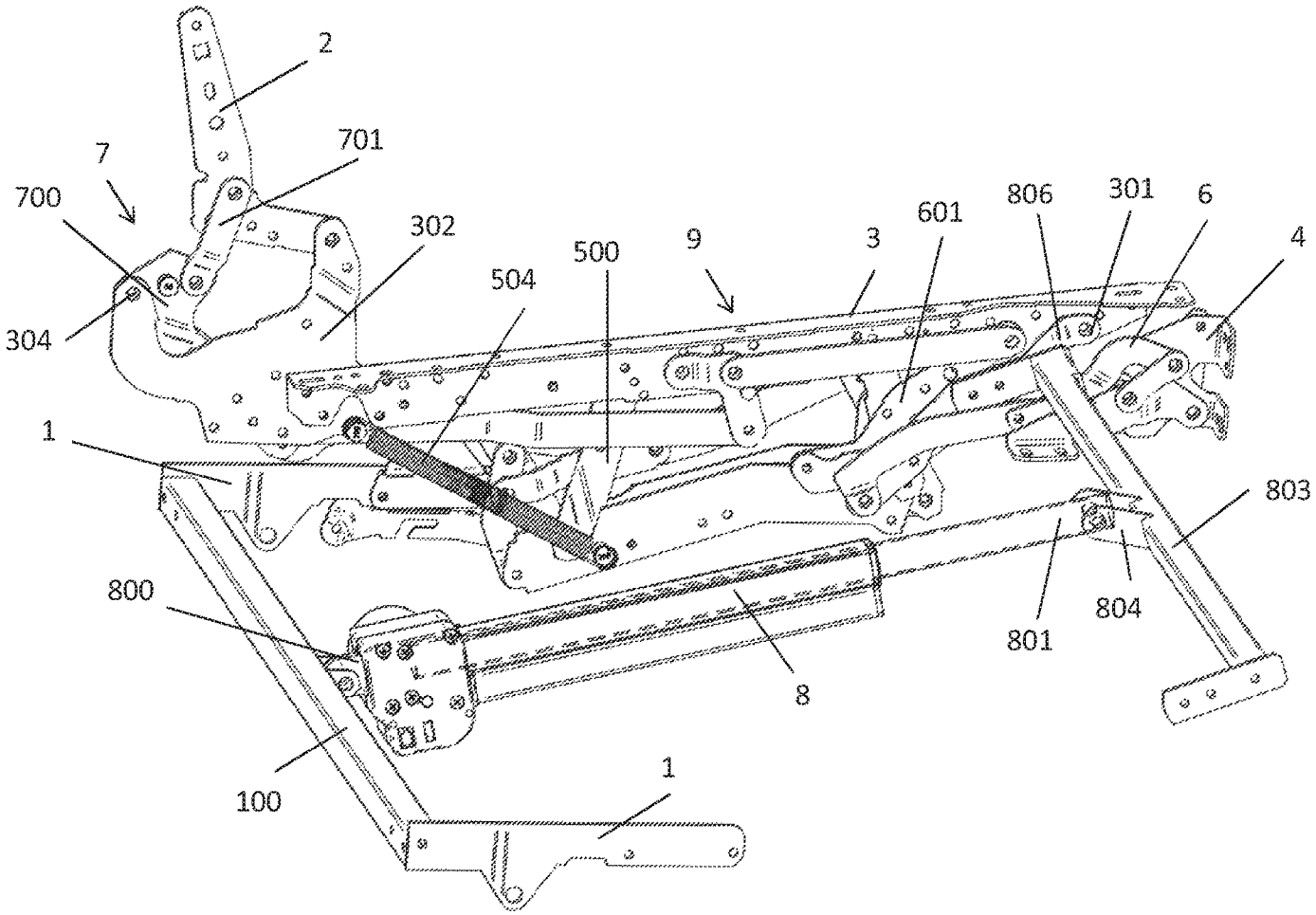
FIG. 3A shows a three-dimensional view in the position according to FIG. 1A.
Figure 3B:
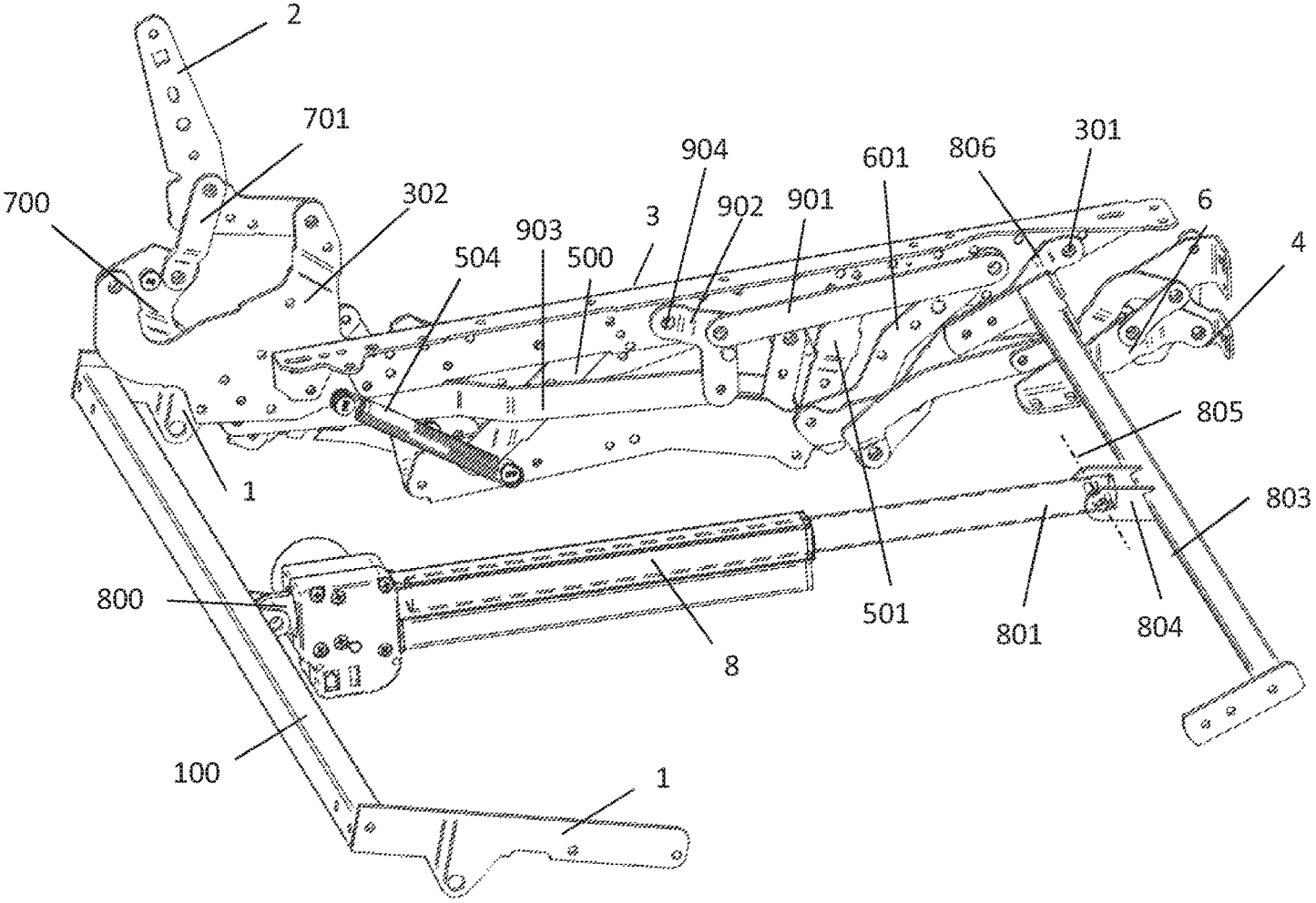
FIG. 3B shows a three-dimensional view in the position according to FIG. 1B.
Figure 3C:
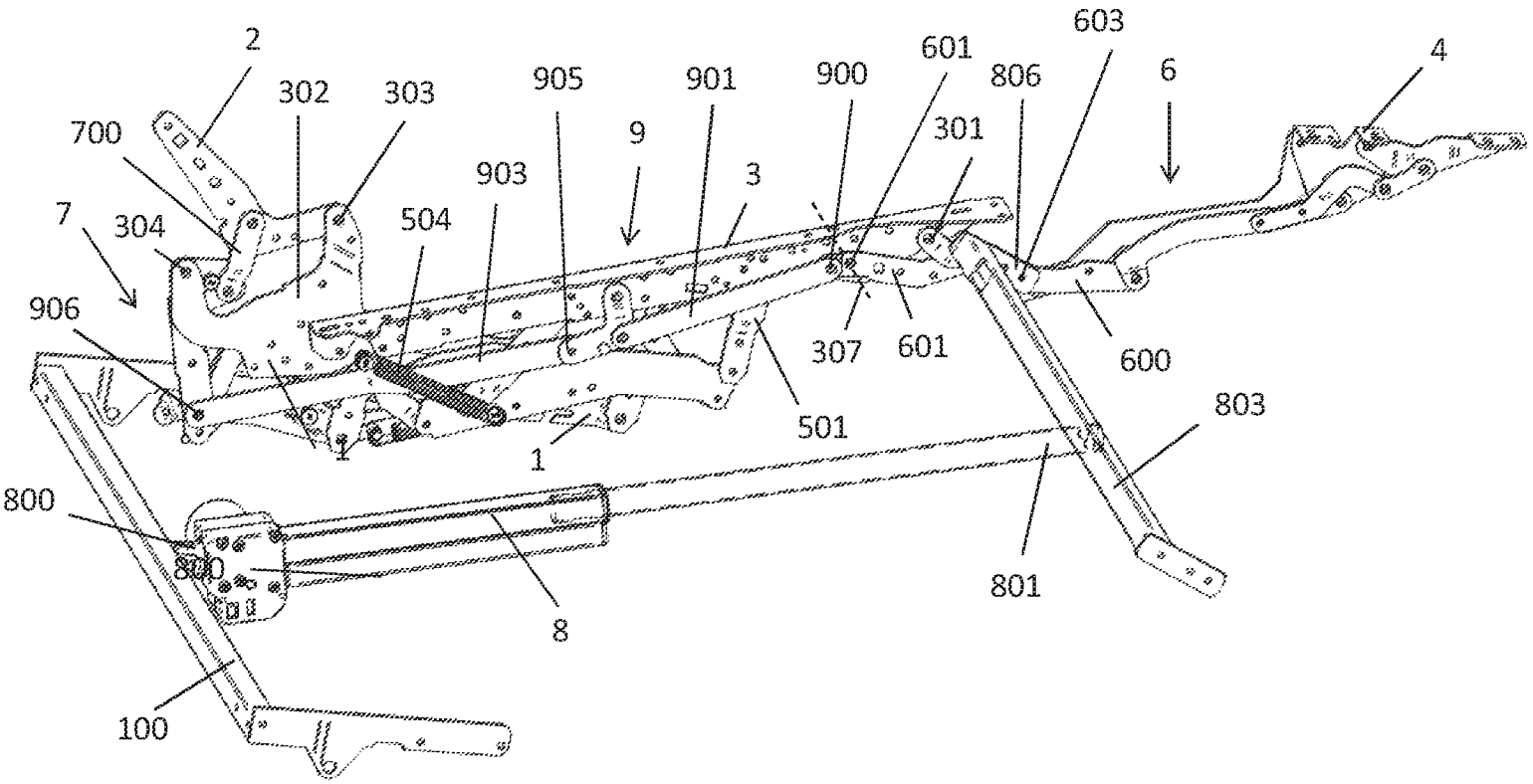
FIG. 3C shows a three-dimensional view in the position according to FIG. 1C.

At the short lever arm 804, the second end 801 of the linear actuator 8 is articulatedly coupled to the support 803 about a first articulation axis 805. In addition, the second scissor arm 601 of the footrest adjustment mechanism 6 on the seat element 3A is coupled to the first articulation point 301, which forms a second articulation axis 307 that is oriented in parallel to the first articulation axis 805. Both axes are also oriented perpendicularly with respect to the lift direction of the linear actuator 8, whereby the distance between the first articulation axis 805 and the second articulation axis 307, perpendicular to the lift direction of the linear actuator 8, in the upright base position according to FIGS. 1A, 2A, and 3A is smaller than at the end of the first partial lift of the linear actuator. The distance, if present at all, is only a few millimeters. However, this distance represents the lever arm via which the force of the linear actuator is transmitted to the footrest adjustment mechanism 6 in order to extend the footrest 4. The smaller this lever arm, the greater the force that is necessary for extending the footrest. In contrast, the force required for the displacement and pivoting movement of the seat element 3 relative to the frame 3 [sic; 1] is much less during the first partial lift, so that, as desired, only the displacement and tilting movement of the seat element 3 takes place during the first partial lift, while the footrest 4 undergoes little or no movement.

During the first partial lift, the movement of the seat element 3 causes an increase in the distance between the first articulation axis 805 and the second articulation axis 307, so that the lever arm, which acts to transmit force, is lengthened until the footrest 4 is now extended during the second partial lift. In addition, to assist in the displacement and pivoting movement of the seat element 4, at least one spring element 504 may be provided which is situated between the frame 1 and the seat element 3, or, as in the illustrated exemplary embodiment, between the seat element 3 and the seat element adjustment mechanism 5. In the upright base position according to FIG. 1A, the spring is pretensioned in such a way that the movement of the seat element 3 into the first intermediate position according to FIG. 1B is assisted.

During the second partial lift of the linear actuator 8, on the one hand the footrest 4 is extended, and on the other hand this results in synchronous inclination of the backrest 2 relative to the seat element 3, the seat element 3 also being further inclined by the front end 300 being further lifted. In the reclining position according to FIG. 1C, the angle γ between the backrest 2 and the seat element 3 has increased by approximately 20°. For an oppositely directed activation of the linear actuator 8, starting from the reclining position according to FIG. 1C, a corresponding opposite movement of the backrest 2, seat element 3, and footrest 4 takes place. In particular, the first intermediate position according to FIG. 1B is also reached.

The mechanism described above, by use of a single linear actuator 8, thus allows a movement of the seat element 3 and backrest 2 independently of the footrest 4 during the first partial lift, and allows a synchronous movement of the backrest 2, seat element 3, and footrest 4 during the second partial lift.

In the exemplary embodiment described above, the crossmember 803 is articulatedly connected to the seat element 3 via the first articulation point 301. However, the crossmember 803 is also articulatedly coupled to the first scissor arm 600 of the footrest adjustment mechanism via the short lever arm 804. This coupling to the footrest adjustment mechanism 6 results in good stability and rigidity of the footrest 4 during use, in particular in the reclining position according to FIG. 1C.

Within the scope of the invention, however, it would also be conceivable for the actuator 8 to be coupled only to the seat element 3, and for the movement of the footrest 4 to be transferred only via the linkage mechanism 9.

Figure 4:
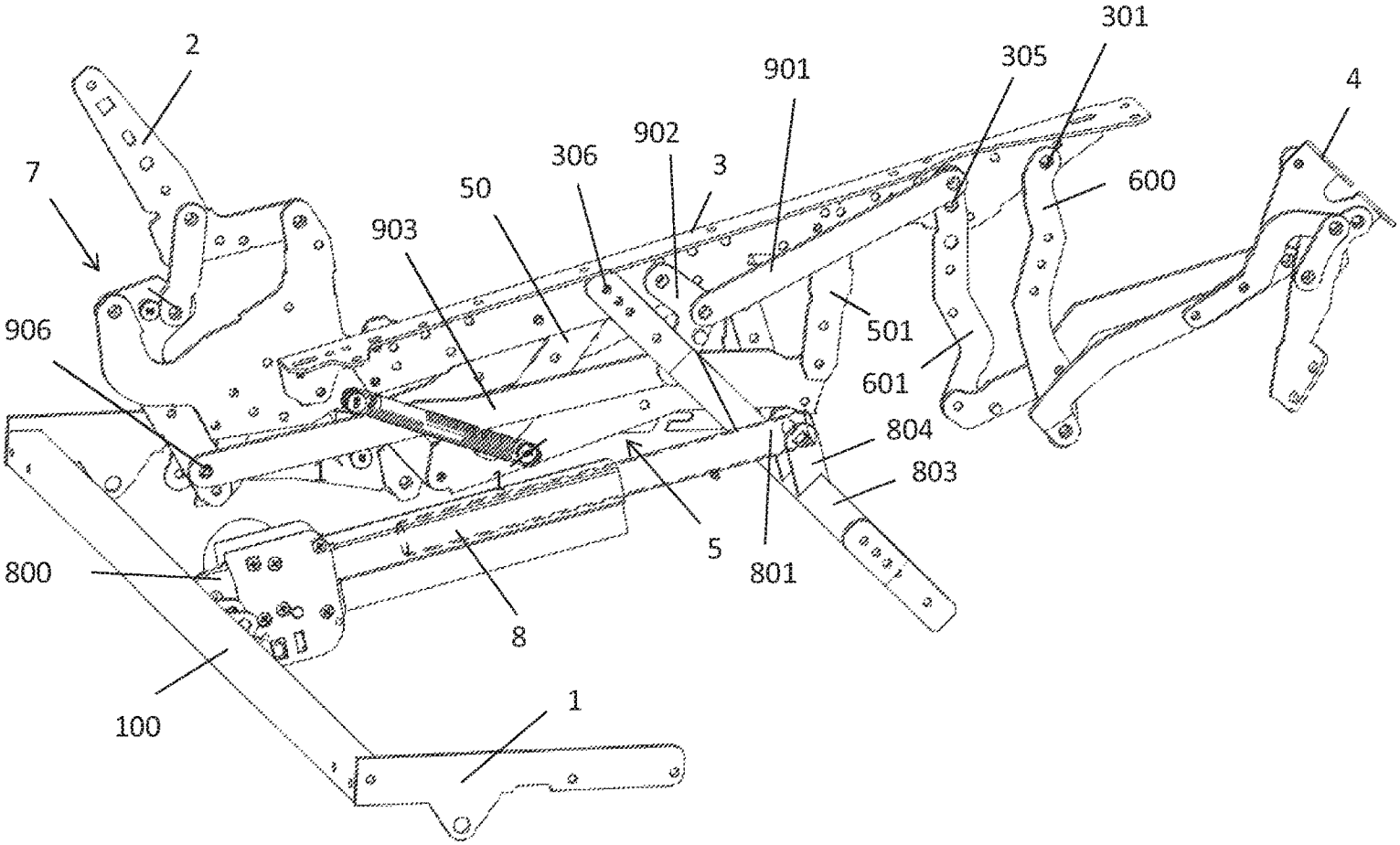
FIG. 4 shows a three-dimensional view of another exemplary embodiment in a position during the second partial lift.

Such an alternative exemplary embodiment is illustrated in FIG. 4. The same reference numerals have been used for identical parts for better understanding.

It is apparent that the first scissor arm 600 of the footrest adjustment mechanism 6 at the first articulation point 301, and the second scissor arm 601 at a fourth articulation point 305, are articulatedly connected to the seat element 3. The movement of the footrest 4 then takes place solely via the first linkage part 901 of the linkage mechanism 9 connected to the second scissor arm 601. The actuator 8 via its crossmember 803 is articulatedly coupled to a fifth articulation point 306, and via this coupling point transfers the lift of the linear actuator 8 to the seat element 3.

The invention claimed is:

1. Seating and lounging furniture having a frame, a backrest, a seat element, and a footrest, wherein the seat element is connected to the frame by means of a seat element adjustment mechanism for a displacement and tilting movement of the seat element relative to the frame the footrest is connected to a front end of the seat element by means of a footrest adjustment mechanism for extending and retracting the footrest, the backrest is connected to a rear end of the seat element and to the frame via a backrest adjustment mechanism, only one linear actuator is provided for adjusting the seat element, the footrest, and the backrest between an upright base position and a reclining position of the seating and lounging furniture, wherein a first end of the actuator is coupled to the frame, and a second end is coupled to the seat element, the linear actuator when actuated generates a linear lift, made up of a first partial lift and a second partial lift, the first partial lift bringing about the displacement and pivoting movement of the seat element relative to the frame without an extension or retraction of the footrest, and the second partial lift bringing about a synchronous inclination of the backrest relative to the seat element and an extension or retraction of the footrest relative to the seat element.

2. The seating and lounging furniture according to claim 1, wherein the seat element and the backrest in the base position enclose a first angle ($\alpha$), and at the end of the first partial lift enclose a second angle ($\beta$), the first angle ($\alpha$) and the second angle ($\beta$) differing from one another by less than 10°.

3. The seating and lounging furniture according to claim 1, wherein the angle between the seat element and the backrest during the second partial lift increases by an angle of at least 10°.

4. The seating and lounging furniture according to claim 1, wherein a stop element is provided which comes into contact with the seat element adjustment mechanism at the end of the first partial lift of the linear actuator.

5. The seating and lounging furniture according to claim 1, wherein a linkage mechanism is provided which connects the backrest, the seat element, and the footrest to one another.

6. The seating and lounging furniture according to claim 5, wherein the linkage mechanism includes a first linkage part, a second linkage part, and a third linkage part that are coupled together.

7. The seating and lounging furniture according to claim 5, wherein the first linkage part couples the footrest adjustment mechanism to the second linkage part, the second linkage part is coupled to the seat element, and the third linkage part couples the second linkage part to the backrest adjustment mechanism.

8. The seating and lounging furniture according to claim 1, wherein at least one spring element is provided between the frame and the seat element, or between the frame and the seat element adjustment mechanism, for assisting in the displacement and pivoting movement of the seat element.

9. The seating and lounging furniture according to claim 1, wherein the force to be applied for actuating the seat element adjustment mechanism, starting from the upright base position, is less than the force to be applied for actuating the footrest adjustment mechanism.

10. The seating and lounging furniture according to claim 1, wherein the linear actuator is coupled to the seat element via a crossmember.

11. The seating and lounging furniture according to claim 10, wherein the second end of the linear actuator is articulatedly coupled to the crossmember about a first articulation axis, and the footrest adjustment mechanism is coupled to the seat element about a parallel second articulation axis, whereby the distance, perpendicular to the lift direction of the linear actuator, between the first and the second articulation axis, in the upright base position is smaller than at the end of the first partial lift of the linear actuator.

12. The seating and lounging furniture according to claim 11, wherein the distance, perpendicular to the lift direction of the linear actuator, between the first and the second articulation axis is less than 3 mm in the upright base position of the sitting and reclining furniture.

13. The seating and lounging furniture according to claim 10, wherein the crossmember is also connected to the footrest adjustment mechanism.

14. The seating and lounging furniture according to claim 1, wherein the seat element adjustment mechanism moves the seat element from the upright base position into a first intermediate position at the end of the first partial lift, wherein in the upright base position a first clear distance is formed between the front end of the seat element and a floor, and in the first intermediate position a second clear distance (h2) is formed between the front end of the seat element and a floor, the first clear distance (h1) being less than the second clear distance (h2).

15. The seating and lounging furniture according to claim 14, wherein the clear distance from the floor, necessary for extending and retracting the footrest, is greater than the first clear distance (h1) that is present in the upright base position, and less than the second clear distance (h2) that is present in the first intermediate position.

* * * * *